24-70 SF
10/15/85 4,546,521

United States Patent [19]

Ribarits

[11] Patent Number: 4,546,521

[45] Date of Patent: Oct. 15, 1985

[54] FASTENER FOR SPORTS SHOES

[75] Inventor: Peter Ribarits, Vienna, Austria

[73] Assignee: Skischuhfabrik Dynafit Gesellschaft m.b.H., Graz, Austria

[21] Appl. No.: 599,170

[22] Filed: Apr. 11, 1984

[30] Foreign Application Priority Data

Apr. 11, 1983 [AT] Austria ..... 1273/83

[51] Int. Cl.[4] ..... A43C 11/14

[52] U.S. Cl. ..... 24/70 SK; 24/69 SK; 24/586; 36/50; 280/633

[58] Field of Search ..... 24/68 R, 68 SK, 68 T, 24/69 R, 69 SK, 69 J, 70 SK, 70 J, 71 R, 71 SK, 586, 683, 685; 36/50; 280/621, 633

[56] References Cited

U.S. PATENT DOCUMENTS

| | | | |
|---|---|---|---|
| 1,489,126 | 4/1924 | Jansizian | 36/50 X |
| 2,199,444 | 5/1940 | Rauglas | 24/70 SK |
| 3,678,539 | 7/1971 | Graup . | |
| 3,807,748 | 4/1974 | Ramillon | 280/633 |
| 4,011,634 | 3/1977 | Olivieri | 24/70 SK |
| 4,068,352 | 1/1978 | Uhricek et al. | 24/69 SK |
| 4,096,605 | 6/1978 | Annovi | 24/70 SK |
| 4,310,951 | 1/1982 | Riedel | 24/70 SK |

FOREIGN PATENT DOCUMENTS

| | | | |
|---|---|---|---|
| 276180 | 2/1969 | Austria | 280/633 |
| 350437 | 5/1979 | Austria . | |
| 70272 | 1/1983 | European Pat. Off. | 24/68 SK |
| 1251181 | 9/1967 | Fed. Rep. of Germany . | |
| 2628395 | 1/1979 | Fed. Rep. of Germany . | |
| 2062082 | 6/1971 | France . | |
| 2340749 | 9/1977 | France | 280/633 |
| 2475372 | 8/1981 | France . | |
| 2534117 | 4/1984 | France . | |
| 453952 | 6/1968 | Switzerland | 24/71 SK |
| 477179 | 10/1969 | Switzerland | 24/70 SK |

*Primary Examiner*—William E. Lyddane
*Assistant Examiner*—James R. Brittain
*Attorney, Agent, or Firm*—Fleit, Jacobson, Cohn & Price

[57] ABSTRACT

A fastener for sports shoes, particularly for skiing boots or mountaineering boots, comprises a base member (1), which is adapted to be secured to one side part of the quarter of the shoe and is provided with a track (10), which extends in the direction in which the fastener is to be tightened. That track receives a slider (2). A tightener lever (4) is pivoted on said slider and provided with a loop member (5), which is adapted to be hung into a hook provided on the other side part of the quarter. A locking block is provided for connecting the slider (1) in the desired position.

11 Claims, 5 Drawing Figures

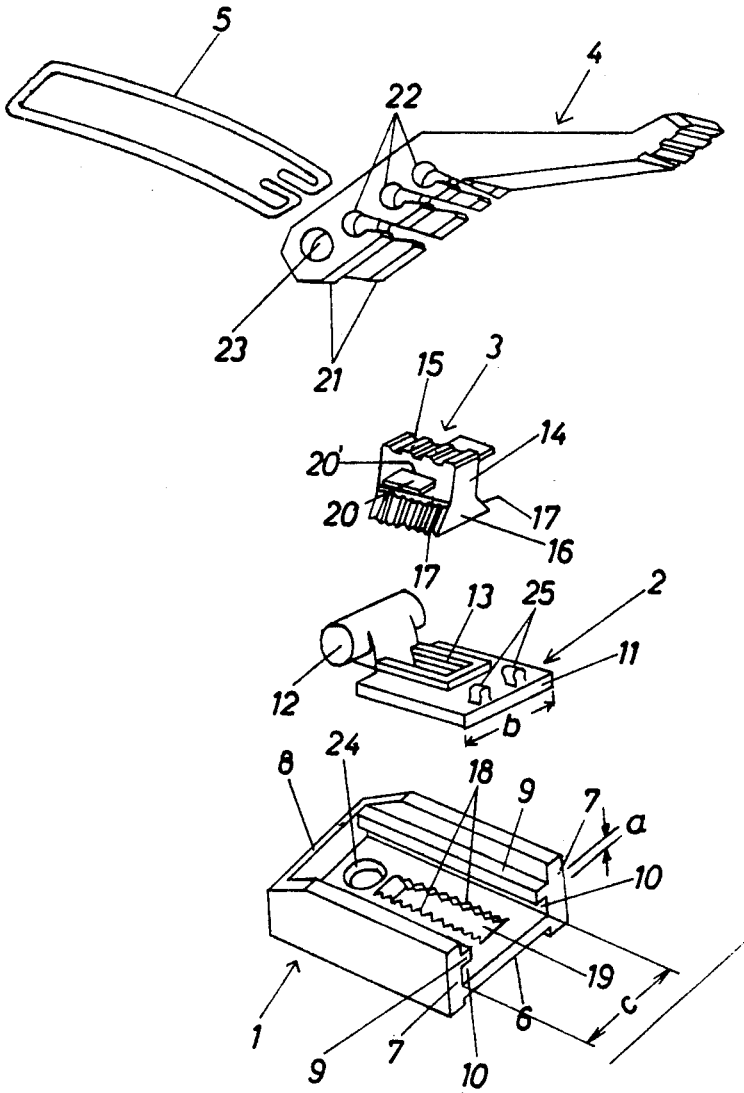
FIG. 3
FIG. 4
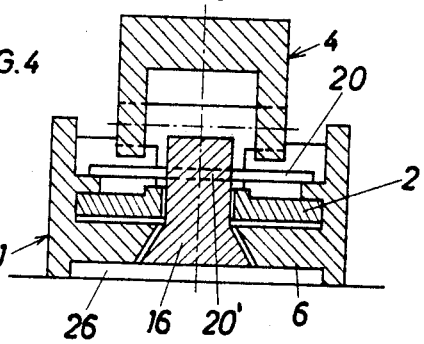
FIG. 4A
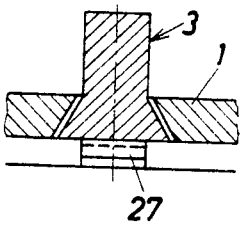

FASTENER FOR SPORTS SHOES

This invention relates to a fastener for sports shoes, particularly for skiing boots or mountaineering boots. The fastener should permit of a fine adjustment to be effected with simple means and in a simple manner. It is also an object of the invention to provide a fastener consisting of components which can easily be made and can be assembled without need for a particularly high expenditure and for tools.

In accordance with the invention the fastener comprises a base member, which is adapted to be secured to one side part of the quarter of the shoe and provided with a track extending in the direction in which the fastener is to be tightened, a slider, which is received by the track, a tightener lever, which is pivoted to the slider and provided with a loop member that is adapted to be hung into a hook provided on the other side part of the quarter of the shoe, and locking means for connecting the slider to the base member in a desired position.

Further details of the invention will be explained more fully with reference to the drawing, which shows an illustrative embodiment of the fastener according to the invention.

FIG. 3 is an exploded view showing the fastener.

FIG. 4 is a sectional view taken on line IV—IV in FIG. 1.

FIG. 4A shows a modification of the design of FIG. 4.

Figure 1:
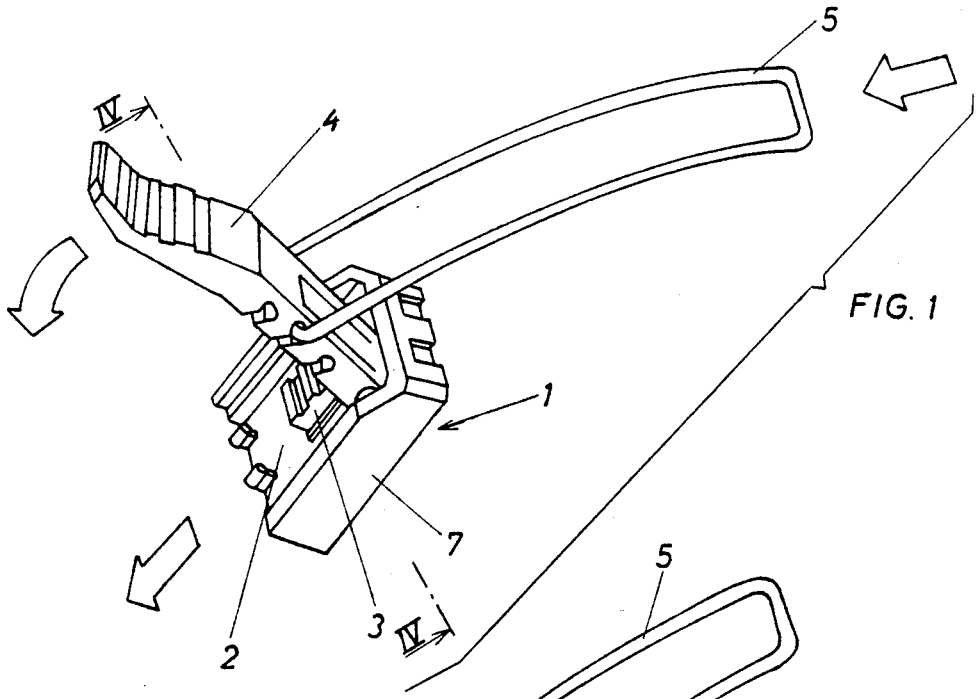
FIG. 1 shows the fastener in an open position.

The fastener according to the invention comprises a base member 1, a slider 2, a locking block 3, a tightener lever 4, and a loop member 5, which is adapted to be hung into a hook, not shown, which is provided on the opposite side part of the quarter of the shoe.

The base member 1 comprises a bottom plate 6 and cheeks 7, which protrude from the side edges of the bottom plate and are connected at one end by a crosspiece 8. The cheeks 7 constitute a track, which is outwardly open at the other end of the cheeks 7. Each cheek 7 is provided with a rib 9, which extends along the cheek 7 and is spaced by a distance-a-from the bottom plate 6. Said ribs 9 and the bottom plate 6 constitute a track 10 for receiving the slider 2.

The slider 2 comprises a plate 11, which has a width-b-that is slightly smaller than the inside width of the track 10. The thickness of the plate 11 is slightly smaller than the inside height-a-of the track. At that end which faces the crosspiece 8, the plate 11 is provided with a pivot pin 12, which is parallel to the crosspiece 8 and on which the tightener lever 4 is pivotally mounted. The plate 11 is formed with a slot 13, which extends along and is centered on the longitudinal center line of the plate 11 and in the present case is rectangular.

The slider 2 is adapted to be connected to the base member 1 by means of a locking block 3, which has a prismatic portion 14 conforming to the slot 13 so that it is adapted to fit said slot substantially without a backlash. The upwardly protruding end portion of the prismatic portion 14 constitutes a grip or is provided with grooves 15 so that the locking block 3 can easily be actuated by the user with the fingers of his or her hand in a manner which will be described more in detail hereinafter. The prismatic portion 14 merges at its lower end into a portion 16, which is trapezoidal in cross-section and which on those faces 17 that extend in the direction of movement of the slider 2 is provided with teeth. Said teeth cooperate with mating teeth 18, which are formed on the bottom plate of the base 6 and protrude into an aperture 19 that is formed on said bottom plate and congruent to the trapezoidal portion 16.

The aperture 19 is longer than the locking block 3 so that the latter can be adjusted along the base member 1 in the aperture 19 and will carry the slider 2 along. A leaf spring 20 is fitted in the prismatic portion 14 and protrudes on both sides thereof and in the assembled fastener rests on the ribs 9.

The tightener lever 4 is forked and comprises two legs 21, which are first outwardly deflected and then released so that openings 23 formed in the legs receive the end portions of the pivot pin 12. It will be understood that the tightener lever 4 can be connected to the slider 2 by any other suitable means, e.g., by means of a pin or the like which is slidably fitted in the openings 23. The loop member 5 can be selectively snapped into any of the openings 22, which are formed in the tightener lever 4 and are parallel to the openings 23 for mounting the tightener lever on the pivot pin 12.

The fastener can be assembled as follows. The tightener lever 4 is first mounted on the pivot pin 12 in the manner described hereinbefore. Then the slider 2 is inserted into the track 10 of the base member 1. Thereafter the locking block 3 is inserted from below into the aperture 19 to such an extent that the grooved surface 15 of the prismatic portion protrudes upwardly from the slot 13, the leaf spring 20 is then inserted through an opening 20' formed in the prismatic portion 14 so that the leaf spring bears on both ribs 9. The leaf spring 20 can then be secured by means of an adhesive in the opening of the prismatic portion 14 (FIG. 4).

The slider 2 is then pushed forwardly to such an extent that a conical opening 24 is exposed, which is provided in the bottom plate 6 between the slot 13 and the crosspiece 8 and is adapted to receive a rivet for connecting the fastener to one side part of the quarter of the shoe. The base member 1 is pivoted to said rivet so that the loop member 5 can adapt itself to the shape of the hook, not shown, which is provided on the other side part of the quarter of the shoe. The tightener lever 4 is mounted on the pivot pin 12 in such a manner that in the closed position of the fastener, shown in FIG. 3, the axis on which the loop member 5 is mounted in the openings 22 is below the pivotal axis provided by the pivot pin 12 so that the tightener lever must be moved beyond a dead center to its closed position and also to its open position so that the fastener cannot be inadvertently opened.

When the loop member 5 has been hung into a hook on the other side part of the quarter of the shoe, the fastener can be tensioned in that the tightener lever 4 is turned about the pivot pin 12 so that the loop member 5 will pull the hook over a certain distance toward the slider 2. When it is desired to change that distance, a coarse adjustment may be effected in that the loop member 5 is inserted into a different pair of openings 22. For a fine adjustment, the locking block 3 is depressed so that its lower portion disengages from the teeth 18 of the bottom plate 6 and enters a recess 26 provided on the underside of the base member 1. The locking block 3 can now be adjusted along the aperture 19 and during said adjustment will carry the slider 2 along. As the locking block 3 is depressed, the leaf spring 20 bearing on the upper surfaces of the ribs 9 will be deflected and will exert a restoring force, which will raise the locking block 3 when it has been released so that the locking block in its new adjusted position will snap into the teeth 18 so as to hold the slider 2 in position.

Figure 2:
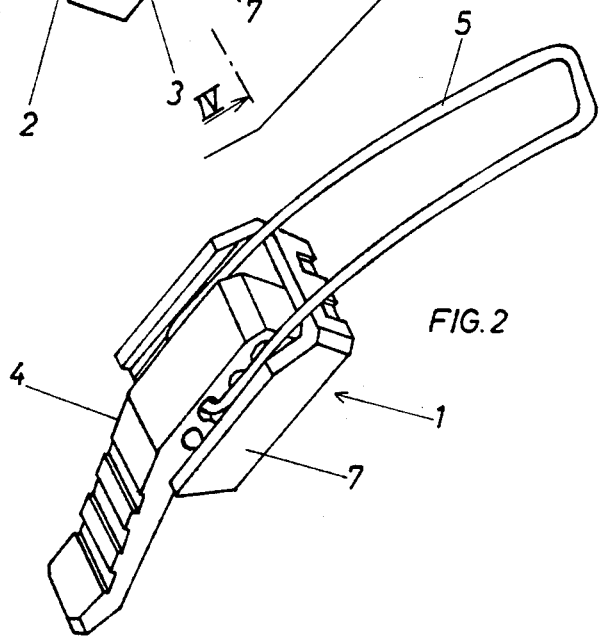
FIG. 2 shows the fastener in a closed position.

As the tightener lever 4 approaches its closed position it is forced to snap in between upstanding detent elements 25, which are provided on the top of the plate 11 and tend to retain the lever 4 in its closed position shown in FIG. 2.

It will be understood that various changes in design may be adopted within the scope of the invention. For instance, a design such as that shown in FIG. 4A may be used, in which a leaf spring 27 is provided, which urges the locking block 3 upwardly. That leaf spring 27 may be secured to the locking block 3 and may have approximately the same length as the latter, or the leaf spring 27 may have the same length as the aperture 19 and in that case may be secured to the corresponding side part of the quarter of the shoe or to the base member 1. It will be understood that means for urging the locking block upwardly may consist of any spring element which subjects the locking block either to an upward pressure or to an upward tension, as is shown by way of example in the two embodiments which have been illustrated. In another modification the underside of the base member 1 may be curved to conform to the curvature of the surface of the shoe. The loop member 5 may be replaced by a different retaining link, which is adapted to interlock with a hook or other suitable retaining member provided on the other side part of the quarter of the shoe.

What is claimed is:

1. A fastener for sports shoes, comprising a base member, which is adapted to be secured to one side part of a quarter of a shoe, a slider, which is mounted on said base member and slidable along the same in a tightening direction and adapted to be fixed in position to said base member, a tightener lever pivoted to said slider, a loop member pivoted to said tightening lever, said base member formed with an elongated aperture, which extends in the tightening direction and formed with teeth protruding into said elongated aperture, said fastener also comprising a locking block, which is inserted from below into said elongated aperture and extends through said elongated aperture and through a registering closely fitting slot formed in said slider and protrudes above said slider and has teeth in mesh with said teeth of said base member, and spring means engaging between said locking block and one of said base member and said shoe quarter for urging said locking block upwardly so that the locking block when depressed against the force of said spring means disengages said teeth of said locking block from said teeth of said base member and the slider and locking block can then be displaced along said elongated aperture.

2. A fastener according to claim 1, characterized in that said elongated aperture in said base member and that portion of the locking block which extends in said elongated aperture have in cross-section substantially the shape of a downwardly widening trapezoid and the base member is provided on its underside with a recess for receiving the locking block as it is depressed.

3. A fastener according to claim 2, characterized in that the locking block has above that portion which is trapezoidal in cross-section a prismatic portion and the slot in the slider conforms to and receives said prismatic portion.

4. A fastener according to claim 2, wherein said spring means comprises a leaf spring provided in said recess on the underside of the base member.

5. A fastener according to claim 1, characterized in that the base member comprises a bottom plate and side cheeks which rise from the bottom plate and are formed with ribs protruding toward each other and together with the bottom plate define respective grooves for guiding the slider, which comprises a plate that is slidable in said grooves and has a thickness that is smaller than the height of said grooves.

6. A fastener according to claim 5, wherein said spring means comprises a leaf spring, which extends through said locking block and protrudes from it on opposite sides and bears on top of the ribs of said cheeks of the base member.

7. A fastener according to claim 5, characterized in that said grooves are open at one end, which is adjacent to the other side part of the quarter of the shoe, said bottom plate is adapted to be secured to said one side part of the quarter of the shoe by means of a rivet and is pivoted to said rivet, and said rivet extends through an opening which is formed in said bottom plate between said elongated aperture and a crosspiece, which is provided on said bottom plate and closes said grooves at the other end thereof.

8. A fastener according to claim 7, characterized in that said slider is provided at its end facing said crosspiece with a pivot pin and said tightener lever is forked and has two legs and is pivoted to said pivot pin near the free ends of said legs.

9. A fastener according to claim 8, characterized in that the slider is provided at that end which is opposite to said pivot pin with upstanding detent elements for retaining the tightener lever in its closed position.

10. A fastener according to claim 1, characterized in that the locking block comprises an upper end portion which protrudes above said slot of said slider and which constitutes a grip or is formed with grooves to facilitate an actuation of the locking block with one finger of the hand of the user.

11. A sports shoe comprising a shoe quarter having two side parts and a fastener for connecting said two side parts, said fastener comprising a base member secured to one of said side parts, a slider, which is mounted on said base member and slidable along the same in a tightening direction and adapted to be fixed in position to said base member, a tightener lever pivoted to said slider, a loop member pivoted to said tightening lever, said base member formed with an elongated aperture, which extends in the tightening direction and formed with teeth protruding into said elongated aperture, said fastener also comprising a locking block, which is inserted from below into said elongated aperture and extends through said elongated aperture and through a registering closely fitting slot formed in said slider and protrudes above said slider and has teeth in mesh with said teeth of said base member, and spring means engaging between said locking block and one of said base member and said shoe quarter for urging said locking block upwardly so that the locking block when depressed against the force of said spring means disengages said teeth of said locking block from said teeth of said base member and the slider and locking block can then be displaced along said elongated aperture.

* * * * *